US005738457A

United States Patent [19]

Ishida et al.

[11] Patent Number: 5,738,457

[45] Date of Patent: Apr. 14, 1998

[54] PAPER SIZE DETERMINING METHOD AND PRINTER IN WHICH THE METHOD IS USED

[75] Inventors: Hiroshi Ishida; Naoto Yamaguchi; Yukihiro Uchiyama; Kazuhiko Yamaguchi; Masayuki Kumazaki, all of Suwa, Japan

[73] Assignee: Seiko Epson Corporation, Tokyo, Japan

[21] Appl. No.: 559,955

[22] Filed: Nov. 17, 1995

[30] Foreign Application Priority Data

Nov. 18, 1994 [JP] Japan ..... 6-309629

[51] Int. Cl.[6] ..... B41J 29/44

[52] U.S. Cl. ..... 400/706; 400/630

[58] Field of Search ..... 400/630, 703, 400/706, 707.1, 708, 624, 636, 707, 322

*Primary Examiner*—David A. Wiecking
*Attorney, Agent, or Firm*—Stroock & Stroock & Lavan LLP

[57] ABSTRACT

A method of printing on a printing medium is provided, including providing a printing head for printing on a recording medium and conveying the recording medium in a first direction with a conveyer. A detector is positioned on the upstream side of the print head, the detector then detecting a trailing edge of the recording medium. The amount of recording medium conveyance by the conveyer upon the detection of said trailing edge is computed and it is determined whether the recording medium is of a standard size. Thereafter, a printing region on the recording medium is defined in accordance with the size of the recording medium if the recording medium is a standard size. A printer for printing on a printing medium which employs the above method is also provided wherein a detector is positioned upstream of the print head for detecting a trailing edge of the recording medium which is being conveyed. A computer computes the amount of the recording medium conveyance by the conveyer upon the detection of the trailing edge by the detector, and a size determiner determines whether the recording medium is of a standard size and defines a printing region on the recording medium in accordance with the size of the recording medium if the recording medium is of a standard size.

15 Claims, 6 Drawing Sheets

| NUMBER OF STEPS | TYPE OF SHEETS OF PAPER | MAXIMUM PRINTING REGION (x) |
|---|---|---|
| . | . | . |
| . | . | . |
| n1~n1' | A4 LENGTHWISE | x1mm |
| n2~n2' | B4 WIDTHWISE | x2mm |
| n3~n3' | A4 WIDTHWISE | x3mm |
| . | . | . |
| . | . | . |

PAPER SIZE DETERMINING METHOD AND PRINTER IN WHICH THE METHOD IS USED

BACKGROUND OF THE INVENTION

1. Field of the Invention

The present invention relates generally to a printing method and a printer which implements the printing method, and more particularly relates to a priming method and a printer implementing the method which employs a technique for defining a printing region on a recording medium.

2. Related Art

Reference is first made to FIGS. 9(*a*) and 9(*b*), which depict schematic illustrations of a primary portion of a commonly used printer. A recording medium, (in this case, by way of example only a sheet of paper, namely paper sheet 1), a platen 2, a printing head 3 and a detector 5 for detecting paper sheet 1 are depicted in FIGS. 9(*a*) and 9(*b*). During operation, paper sheet 1 is conveyed by platen 2 in the direction of an arrow 4, and at the same time, printing is conducted on paper sheet 1, when held against platen 2 by print head 3. During the use of such a conventional primer, as is illustrated in FIG. 9(*b*), when a trailing edge of paper sheet 1 passes through detector 5, it is determined that the printable area of paper sheet 1 has been used up, and therefore the printing operation is stopped.

The following problems may be encountered during the use of such a conventional printer. As described above, when the trailing edge of paper sheet 1 passes through detector 5, although a printing region L still remains on paper sheet 1 between print head 3 and detector 5, the printing operation is stopped. Therefore, no printing is performed within a distance L from the trailing edge of paper sheet 1, even though part of this area could be printed upon, and thus an area of paper sheet 1 corresponding to the region L is wasted. A printer disclosed in Japanese Unexamined Patent Publication No. 4-115980 has been designed in an attempt to solve the above problems. This printer is designed as follows. When a trailing edge of paper sheet 1 has been detected by detector 5, a starting time is recorded. When paper sheet 1 is conveyed by a conveyer after the starting time, the elapsed conveying time is computed, and the length of paper sheet 1 remaining on the upstream side of print head 3 is determined. The printing operation is continued by print head 3 until the remaining length of paper sheet 1 becomes less than the area of the paper sheet 1 on which printing should be conducted. However, the accuracy of detectors varies, and thus the passing of the trailing edge of paper sheet 1 is not always accurately determined.

The printer as disclosed in Japanese Unexamined Patent Publication No. 4-115980, and described above, operates as follows. When a trailing edge of the paper sheet 1 has been detected by detector 5, a starting time is recorded. After the starting time, the elapsed conveying time is computed, and the length of paper sheet 1 remaining on the upstream side of print head 3 is determined. (This length of paper sheet 1 remaining on the upstream side of print head 5 is referred to as the residual length, hereinafter). Therefore, because of any error in the detection or the trailing edge of paper sheet 1, a discrepancy is caused between the actual residual length of paper sheet 1 and the residual length that has been determined. Further, the error is varied when detector 5 is inaccurate in detecting the trailing edge of paper sheet 1.

Due to the foregoing, for example, there is a possibility that the printing operation is stopped although there is space remaining on paper sheet 1 on which printing can be conducted. Alternatively, there is a possibility that printing is attempted to be conducted on paper sheet 1 although there is not sufficient space on paper sheet 1 for printing.

Sheets of paper and other recording medium available in the market are formed in standard sizes such as sizes A3, A4, B4, B5 and the like. Japanese Unexamined Patent Publication No. 4-122661 discloses an image forming apparatus having a sheet length detecting system which determines the length of paper sheet by detecting the width of the paper sheet. However, the following problems may be encountered during the use of this apparatus. For example, it is impossible for this image forming apparatus to discriminate between the cases when a sheet of size A4 paper is conveyed widthwise (landscape) and when a sheet of size A3 paper is conveyed lengthwise (portrait). The reason is that the width of a sheet of size A4 paper (which is its length when conveyed widthwise, or in landscape mode) is the same as the length of a sheet of size A3 paper conveyed lengthwise, or in portrait mode. Thus, it is impossible to specify the length of a paper sheet through the use of the sheet length detecting system disclosed in Japanese Unexamined Patent Publication No. 4-122661.

Japanese Unexamined Patent Publication No. 63-74672 discloses a recording paper conveyance system used for a printer, comprising: a sensor for detecting the existence of a sheet of recording paper; a means for detecting the amount a sheet of recording paper has been conveyed, and a table on which the size of a sheet (sheet length) processed by the printer and the number of printing lines corresponding to the sheet size are arranged. When the sensor detects the leading and trailing edge of the sheet of recording paper, the length of the sheet of recording paper is determined and the number of lines to be printed on is computed from the result of this measurement, using the above noted table.

FIG. 10 depicts the arrangement of the sheet conveyance mechanism of the printer as disclosed in Japanese Unexamined Patent Publication No. 63-74672, which depicts a print head 3, a sensor 5 and a pair of conveyance rollers 6*a* and b*b*. As described above, with reference to the previously discussed prior art, the detection of the leading and trailing edges of paper sheet 1 is inaccurate. The sheet conveyance system of the printer described in Japanese Unexamined Patent Publication No. 63-74672 operates as follows. The times when the leading edge of paper sheet 1 is detected by sensor 5 and when the trailing edge of paper sheet 1 is detected by sensor 5 are recorded as reference points, and the sheet length is determined using these reference points. Accordingly, both inaccuracy in the detection of the leading or trailing edges of paper sheet 1 by sensor 5 may be compounded. Thus, if the compounded inaccuracy is increased, it is not always possible to accurately measure the sheet size (sheet length). Therefore, during the use of the sheet conveyance system of the printer described in Japanese Unexamined Patent Publication No. 63-74672, it is possible that the same problems mentioned above with respect to Japanese Unexamined Patent Publication No. 4-122661 will occur.

It would be desirable to provide a printing method and a printer which implements a method by which printing can be always conducted in a predetermined region on a recording medium which can be accurately determined when sheets of paper of standard sizes are used for printing.

SUMMARY OF THE INVENTION

Generally speaking, in accordance with the invention, priming is conducted by a printing head while a paper sheet is conveyed by a conveyer. When the trailing edge of the paper sheet is detected by a detector arranged at a position which is a predetermined distance from the conveyer on the upstream side of the print head in the sheet conveyance direction, the print region on the paper sheet in which printing can be conducted is determined as follows:

When the conveyer begins forward conveyance of a paper sheet, measurement of the amount of the paper sheet which is conveyed begins. When the trailing edge of the paper sheet is detected by the detector, the length of the paper sheet is conveyed is determined by the amount of paper sheet conveyance by the conveyer and the predetermined distance between the conveyer and the detector. In accordance with the length of the conveyed sheet determined in the above manner, it is further determined whether the paper sheet is of a standard size or not. When the paper sheet is of a standard length, the actual size of the paper is known.

In this case, even if the detection of the trailing edge of the paper sheet is inaccurate, the former inaccuracy is not compounded. Further the latter inaccuracy is small as compared to the differences in the sizes of standard sheets of paper. Accordingly, the determination of whether a sheet of paper is of a standard size, and the determination of what that size is, will be performed accurately, without errors.

In the system described in Japanese Unexamined Patent Publication No. 63-74672, the determination of the length of the conveyed sheet of paper is made upon the detection of the leading and trailing edges of a paper sheet by the sensor. Accordingly, there is a possibility of the compounding of errors during the detection of the leading and the trailing edges of a paper sheet. On the other hand, according to the invention, the length of the conveyed sheets of paper are determined from the amount the paper sheet is actually conveyed by the conveyer until the trailing edge is detected by the sensor located a predetermined distance from the conveyer. Therefore, inaccuracies of the leading edge during detection are not compounded. Consequently, it is possible to determine more precisely whether the paper sheet is of a standard size or not and what that standard size is.

When the paper sheet is determined to be of a standard size, a region on the sheet in which printing can be conducted is then known, and is matched to the standard size of the sheet. As described above, the length of the residual portion of the sheet on which printing can be conducted is not determined from when the trailing edge of the paper sheet is detected, as is done in the prior art. Rather, after determining that a paper sheet is of a standard size, a region on the sheet in which printing can be conducted is known based on the standard size of the paper sheet. Accordingly, even if variations are caused in the accuracy of detection of the leading edge by the sensor, the region on the sheet in which printing can be conducted can be always accurately determined based upon the standard size of the paper sheet.

As illustrated in FIG. 10, Japanese Unexamined Patent Publication No. 63-74672 discloses a structure in which sensor 5 is arranged on the downstream side (on the printing head side) of a sheet conveyance start position 7 (the contact position of the pair of rollers *6b*). This structure allows the realization of the system described in this patent publication, which still requires that both edges of paper sheet 1 be detected by sensor 5. Moreover, if sensor 5 is arranged on the upstream side of the conveyance start position 7, such as in the invention, it is impossible to compute the quantity of conveyed sheet by the system described in the aforementioned patent publication. This is because the length of the sheet is computed starting when the leading edge of paper sheet 1 is detected by sensor 5. Therefore, when sensor 5 is arranged on the upstream side of the conveyance start position 7, even when sensor 5 detects the leading edge of paper sheet 5, the sheet conveyance is not started then, and thus, the measure of the length of the paper sheet may be impossible.

According to the invention, the start point of computation of the length of the paper sheet conveyed is when the sheet conveyance is actually started. Accordingly, even if the detector is arranged on the downstream side of the sheet conveyance start position, or alternatively even if the detector is arranged on the upstream side of the sheet conveyance start position, the length of sheet conveyance can be positively and more accurately computed. Accordingly, it is possible to positively determine whether the sheet is of a standard size or not.

According to the invention, a paper sheet is conveyed by the conveyer and printing is conducted on the paper sheet by the print head. The detector for detecting a trailing edge of the paper sheet is arranged on the upstream side of the print head in the sheet conveyance direction. Accordingly, the trailing edge of the paper sheet is detected before it reaches the printing head.

After the trailing edge of the paper sheet has been detected by the detector, the length of the paper sheet conveyed from the start of conveyance of the paper sheet until the detection of the trailing edge of the paper sheet by the detector is computed by the computer. In accordance with the length of the paper sheet conveyed as computed by the computer, it is determined by the size determiner whether the sheet is of a standard size or not.

When it is determined by the size determiner that the sheet is of a standard size, a region on the sheet in which printing can be conducted is defined by the printing region definer in accordance with the size of the paper sheet, and the printing operation is then completed.

According to the invention, the remaining printable area of the paper sheet is not determined solely by the detector in accordance with a point in time when the trailing edge of the paper sheet is detected. Rather, the length of the paper sheet is computed from when the conveyance of the paper sheet begins until the detection of the trailing edge of the paper sheet by the detector, and it is then determined whether the sheet is of a standard size or not. If the paper sheet is of a standard size, a region on the sheet in which printing can be conducted is defined in accordance with the standard size of the paper sheet. Accordingly, even if the detector is inaccurate, the region on the paper sheet in which printing can be conducted can be always accurately defined in accordance with the size of the paper sheet.

Accordingly, unlike the printer disclosed in Japanese Unexamined Patent Publication No. 4-115980 described above, there is no possibility that the printing operation is stopped although there is space remaining on the paper sheet on which printing can be conducted. Nor is there any possibility that printing will be attempted even though there is not sufficient space on the paper sheet for printing.

Further, unlike the system described in Japanese Unexamined Patent Publication No. 63-74672, even when the detector is arranged on the upstream side of the conveyance start position, it is possible to determine whether the paper sheet is of a standard size or not.

According to the invention, the conveyor means is driven by a step motor, and the computer counts the number of driving steps of the step motor, so that the number of driving steps is used as a measure of the amount of paper sheet conveyance. Therefore, the amount of the sheet which has been conveyed by the printer may be computed by the use of a relatively simple structure. The amount the sheet that has been conveyed by the printer may be computed by using a rotary encoder attached to a roller which rotates when in contact with a conveyed sheet. However, if a rotary encoder is employed, it is necessary to attach this rotary encoder to the roller. Consequently, the structure becomes complicated. On the other hand, according to the printer of the invention, the number of driving steps of the step motor for driving the conveyer is counted. Therefore, it is not necessary to provide a separate rotary encoder, and the amount the sheet has been conveyed can be computed by the use of a relatively simple structure.

Further, according to the invention, the computer can count the number of driving steps from when the start of forward rotation of the step motor to drive the platen, and the number of driving steps is used as the measure of the amount of the sheet which has been conveyed. In the printer, commonly, a leading edge of the paper sheet is aligned when this leading edge comes into contact with the nip portion of the platen and the pinch roller. Due to the foregoing, simultaneously when the platen is driven in the forward direction, the conveyance of a sheet is started. Accordingly, it is possible to compute the amount of the sheet which has been conveyed through the use of a relatively simple structure.

The invention may also include an automatic sheet feeder by which sheets of printing paper are fed to the conveyer one by one. When a leading edge of a sheet which is fed by the automatic sheet feeder comes into contact with the sheet conveyance start position of the conveyer, the leading edge of the sheet is aligned. Thereafter, simultaneously when the conveyer is operated, the sheet conveyance is started.

Accordingly, it is an object of the invention to provide a printer and method of printing which can accurately print on a recording medium.

It is a further object of the invention to provide a printer and a method of printing which determines if a standard size recording medium is being printed on, and then defines the printing area in accordance therewith.

It is another object of the invention to provide a printer and a method of printing in which printing is performed on a recording medium, filling the entire predefined printable area thereof, but not printing anywhere else but the predefined printable area.

Still other objects and advantages of the invention will in part be obvious and will in part be apparent from the specifications and drawings.

The invention accordingly comprises the several steps and the relation of one or more of such steps with respect to each of the others, and the apparatus embodying features of construction, combinations of elements and arrangements of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
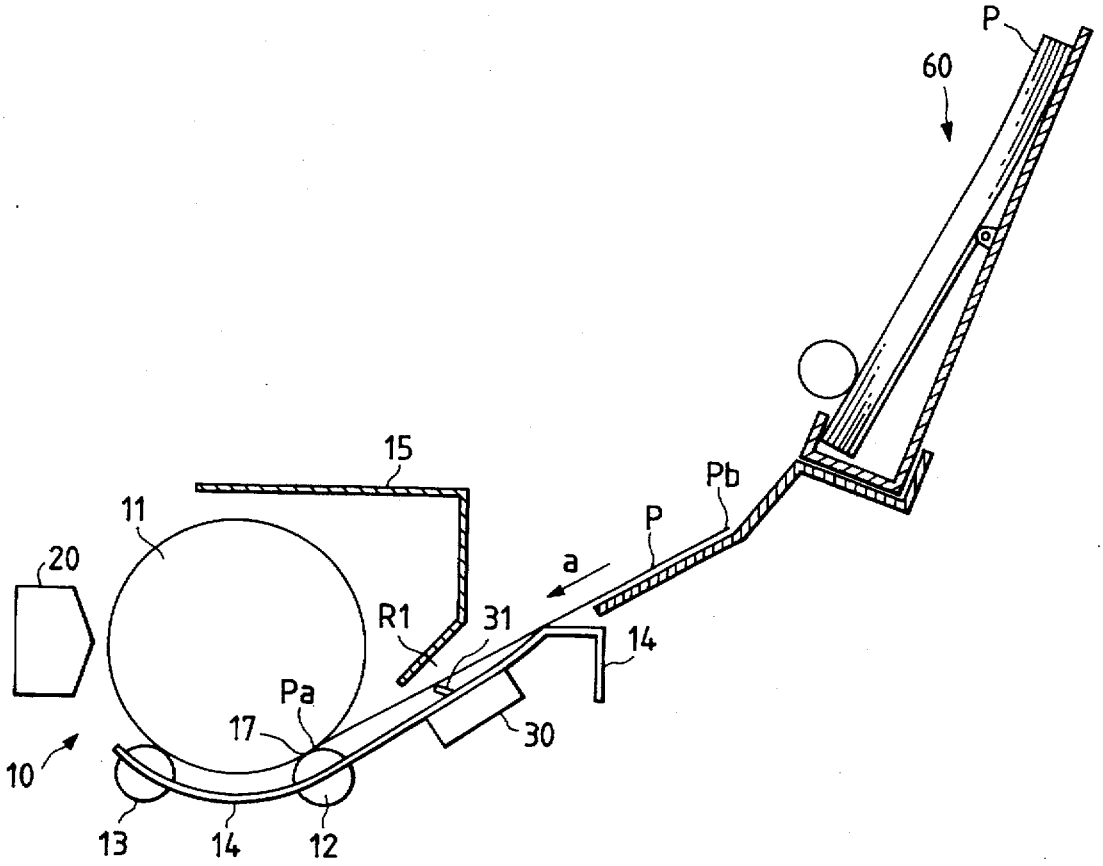
FIG. 1 is a schematic view of the primary portion of the printer constructed in accordance with a first embodiment of the invention in which the printing method of the invention is employed.
Figures 2, 3:
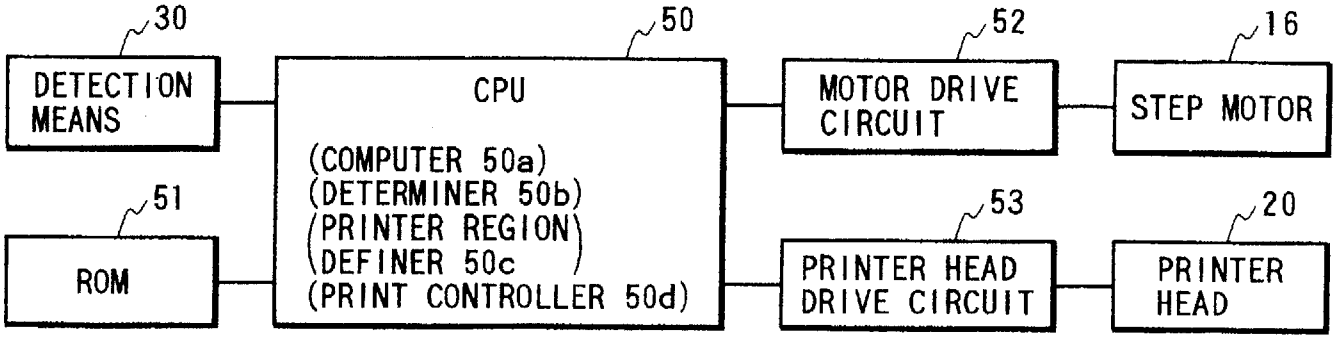
FIG. 2 is a block diagram of the primary portion of the printer of FIG. 1.
FIG. 3 is a schematic illustration of sheet size information.

Reference is first made to FIG. 1 which depicts the primary portion of a printer constructed in accordance with a first embodiment of the invention which also employs the method of the invention. FIG. 2 is a block diagram depicting the method of printing using the printer as shown in FIG. 1. It is understood that the apparatus and method as set forth herein is applicable to printing on any recording medium, reference being made to printing on paper by way of example only, this discussion is not meaning to limit the choice of a particular recording medium in any way.

As is shown in FIG. 1, a conveyer 10 for conveying a paper sheet P includes a platen 11 and pinch rollers 12, 13 which are maintained in pressured contact with platen 11 so that pinch rollers 12, 13 can be rotated thereby. A nip portion 17 is formed between platen 11 and pinch roller 12 as a start position of conveyance of paper sheet P. Platen 11 is rotatably driven by a step motor 16 (not shown, but indicated schematically in FIG. 2) via a gear train not shown in FIG. 1. Pinch rollers 12 and 13 are supported by a first sheet guide 14 which guides a lower surface of paper sheet P. A second sheet guide 15 is provided to guide an upper surface of paper sheet P.

A print head 20, is adapted to print on paper sheet P conveyed in the direction of arrow "a" while the paper sheet P is wound around platen 11. In this case, either an ink jet type printing head, an impact dot type printing head or a thermal type printing head may be employed.

A detector 30 is positioned on the upstream side of print head 20 and also on the upstream side of nip portion 17. Detector 30 is attached to first sheet guide 14. Thus, the distance between detector 30 and nip portion 17 along a sheet conveyance path R1 is known. Detector 30 is provided with a lever 31 which penetrates first sheet guide 14 and faces sheet conveyance path R1. When lever 31 contacts paper sheet P and is rotated thereby counterclockwise in FIG. 1., detector 30 is activated. When lever 31 is released from the paper sheet P and rotates clockwise, that is, when lever 31 is returned to its original position, detector 30 is deactivated. Thus, when paper sheet P is fed into conveyance path R1, a leading edge Pa of paper sheet P passes through lever 31 and detector 30 is activated. Detector 30 remains activated until a trailing end Pb of paper sheet P passes lever 31. After trailing edge Pb paper sheet P has passed lever 31, detector 30 is deactivated. Therefore, it is possible to detect the trailing edge Pb of paper sheet P by a change in the signal sent from detector 30.

Reference is now made to FIG. 2 which is a block diagram depicting the functional relationship between various elements of the invention. A CPU 50 includes a computer 50*a*, a determiner 50*b*, a printer region definer 50*c* and print controller 50*d*. Each of these functions are preferably implemented in software in CPU 50, but could be implemented independently in software or hardware, or in any other manner.

A ROM 51 is also provided which stores sheet size information. The sheet size information is stored in the form of a table, for example, as shown in FIG. 3. As is shown on the table of FIG. 3, "A4 lengthwise", "B4 widthwise", "A4 widthwise" and the like represent a type of a standard size paper sheet. "x1", "x2", "x3" and the like represent the length of each corresponding standard size paper sheet of regular size in the conveyance direction (see also "x" in FIG. 4.). "n1 to n1'", "n2 to n2'", "n3 to n3'" and the like represent a range of the number of driving steps corresponding to the length of a particular standard size paper sheet. For example, the length of a sheet of size A4 is 297 mm. Therefore, when this sheet is conveyed lengthwise (portrait), x1=297. The width of a sheet of size B4 is 257 mm. Therefore, when this sheet is conveyed widthwise (landscape), x2=257. The width of a sheet of size A4 is 210 mm. Therefore, when this sheet is conveyed widthwise (landscape), x3=210. A method of setting the range "n1 to n1'" of the number of steps will be described below.

CPU 50 is connected to a host computer (not shown). Print controller 50*d* controls the operation of step motor 16 via motor driving circuit 52 in accordance with a printing command signal sent from the host computer. Also, print controller 50*d* controls the operation of print head 20 via a print head driving circuit 53.

When trailing edge Pb of paper sheet P is detected by detector 30, computer 50*a* of CPU 50 computes the number of driving steps of step motor 16 which have occurred since the conveyance of paper sheet P began until the detection of trailing edge Pb of paper sheet P. The thus obtained number of steps is used as a measure of the size of paper sheet P.

In this embodiment, computer 50*a* begins to count the number of driving steps when platen 11 starts its normal rotation after paper sheet P has been fed into conveyance path R1 and leading edge Pa of paper sheet P has come into contact with nip portion 17 between platen 11 and pinch roller 12. Thus, the number of driving steps is counted from when step motor 16 begins the normal rotation of platen 11, hereinafter defined as the start point.

The counting of the driving steps does not start when leading edge Pa is detected by detector 30, since detector 30 may be inaccurate to detect when the leading edge or the trailing edge of a sheet is detected. In this embodiment in which a sheet is detected by the rotation of the lever 31, detector 30 is even more inaccurate, though inexpensive. Additionally, the inaccuracies may be compounded if the page length is measured by counting the number of drive steps from when the leading edge Pa is detected by detector 30 until the trailing edge Pb is detected by detector 30. For this reason, it is not preferable to define the starting point of counting the number of driving steps of step motor 16 when leading edge Pa passes detector 30.

Referring once again to FIG. 1, automatic sheet feeder 60 may be attached to the printer of this embodiment so that paper sheets P can be fed by automatic sheet feeder 60, one at a time. When paper sheets P are fed by automatic sheet feeder 60, after detector 30 has been activated, platen 11 is rotated in the reverse direction and leading edge Pa of paper sheet P is made to come into contact with nip portion 17 between platen 11 and pinch roller 12, so that leading edge Pa can be aligned. Thereafter, platen 11 is rotated in the forward direction so as to convey the paper sheet P in the forward direction. As described above, the start point is defined when platen 11 has started its rotation in the forward direction after leading edge Pa of paper sheet P has come into contact with nip portion 17 between platen 11 and pinch roller 12 and has been aligned, that is, after leading edge Pa of paper sheet P has arrived at the staff position for paper sheet conveyance. Therefore, the number of steps of reverse rotation of platen 11 required to align leading edge Pa of paper sheet P are not counted in the overall number of steps required to convey paper sheet P. Rather, the count of the number of steps required to convey paper sheet P is started when platen 11 has started its forward rotation after the reverse rotation. After platen 11 has been rotated in the reverse direction, leading edge Pa of paper sheet P comes into contact with nip portion 17 between platen 11 and pinch roller 12. Accordingly, when platen 11 starts its rotation in the forward direction, conveyance of the paper sheet P is accurately started. Consequently, only a very small error is produced between the number of driving steps of step motor 16 required to convey paper sheet P and completion of the actual conveyance of paper sheet P.

Computer 50*a* counts the number of driving steps of step motor 16 from the start point. In some printers, after leading edge Pa of paper sheet P has been aligned and has passed through pinch roller 12, if necessary, platen 11 is rotated in the reverse direction for any number of reasons, so that sheet paper P is conveyed in the reverse direction. In this case, the number of driving steps in the reverse direction are counted. For example, if the platen 11 is rotated in the reverse direction 100 steps after it has bean rotated in the forward direction 1000 steps, it is computed that the actual number of driving steps in the direction of arrow "a" is 900 steps.

Determiner 50*b* of CPU 50 determines whether or not paper sheet P is of a standard size based on the number of driving steps recorded by computer 50*a*. When trailing edge Pb of paper sheet P is detected by detector 30, determiner 50*b* compares the number "n" of driving steps of step motor 16 counted by computer 50*a* until the detection of trailing edge Pb of paper sheet P by detector 30. This count is then compared to the ranges of valves contained in the table in FIG. 3. Thus, the number of steps is compared to the ranges such as "n1 to n1'", "n2 to n2'" and the like stored in ROM 51. As a result of this comparison, when the number of steps is within one of the ranges of the number of steps such as "n1 to n1'", "n2 to n2'", and the like, it is determined that paper sheet P is of a standard size corresponding to the range in which the number of steps "n" falls. When the number of steps is not within any of the ranges of the number of steps such as "n1 to n1'", "n2 to n2'" and the like, it is determined that paper sheet P is not a standard size and may be of a size different than any standard size, or may be continuous.

The generation of the ranges stored in the table of FIG. 3 will now be explained. In the case of paper sheet P of size A4 which is conveyed lengthwise, the range (n1 to n1') of the number of driving steps of step motor 16 required to fully convey paper sheet P is defined in accordance with equations $n1=n_{x1}, -\alpha$ and $n1'=n_{x1}+\beta$, wherein the number of driving steps computed by computer 50*a* after detection by detector 30 of trailing edge Pb is defined as $n_{x1}$. This assumes no error is produced during the detection of trailing edge Pb. To account for any error, a range is defined about $n_{x1}$ with a range from $n_{x1}-\alpha$ to $n_{x1}+\beta$ In this case, $\alpha$ and $\beta$ are equivalent to a sufficient number of steps to absorb any error during the detection of trailing edge Pb of paper sheet P by detector 30. Accordingly, $\alpha$ and $\beta$ are set equivalent to a predetermined number of steps in accordance with the accuracy of detector 30. Sometimes $\alpha$ may equal 13.

A similar determination of ranges is made in the cases of all the other ranges on the table of FIG. 2, n2 to n2', n3 to n3' and the like. For example, if a paper sheet P of size B4 is conveyed widthwise, the range (n2 to n2') of the number of driving steps of step motor 16 necessary to fully convey paper sheet P is defined in accordance with the equations of $n2=n_{x2}-\alpha$ and $n2'=n_{x2}+\beta$, wherein the number of driving steps computed by computer 50*a* after detection by detector 30 of trailing edge Pb is defined as $n_{x2}$. This assumes no error in the detection. To account for any error, a range is defined about nx2 with a breadth from $n_{x2}-\alpha$ to $n_{x2}+\beta$. Likewise, a similar determination of range is made in the case of paper sheet P of size A4 which is conveyed widthwise. In this situation, the range (n3 to n3') of the number of driving steps is defined in accordance with the equations $n3=n_{x3}-\alpha$ and $n_{x3}+\beta$ wherein the number of driving steps computed by computer 50*a* after detection by detector 30 of trailing edge Pb is defined as $n_{x3}$. This assumes no error in the detection. To account for any error, a range is defined about n3 with a breadth from $n_{x3}-\alpha-$ to $n_{x3}+\beta$. In a preferred embodiment, $n_{x1}=3983$ steps, $n_{x2}=3416$ steps, $n_{x3}=2750$ steps, and $\alpha=\beta=28$ steps.

Accordingly, determiner 50*b* compares the number "n" of driving steps of step motor 16 counted by computer 50*a* until the detection of trailing edge Pb of paper sheet P by detector 30, with the ranges of the number of steps such as "n1 to n1'" and "n2 to n2'" stored in ROM 51 as shown in FIG. 3. As a result of this comparison, if the number of counted steps falls within the range of "n1 to n1", it is determined that the size of paper sheet P is A4 and that the sheet is being conveyed lengthwise. If the number of counted steps falls within the range of "n2 to n2", it is determined that the size of paper sheet P is B4 and that the sheet is being conveyed widthwise and so on.

Some of the ranges may be the same for different types of paper, if the conveying distance is the same, thus requiring the same number of steps by step motor 16. Thus the conveying distance for a paper sheet P of A4 size conveyed in the lengthwise (portrait) direction is the same as that for a paper sheet P of A3 size conveyed in the widthwise (landscape) direction. Similarly the conveying distance for a paper sheet P of B5 size conveyed in the lengthwise (portrait) direction is the same as that for a paper sheet P of B4 size conveyed in the widthwise (landscape) direction.

However, this overlapping of ranges causes no problems in the practicing of the invention. Since the processing is based on the required conveying distance, that this distance is lengthwise or widthwise is irrelevant. Thus, the listing of, for example, A4 lengthwise (portrait) on the table of FIG. 3 would also be sufficient to define A3 widthwise (landscape), since the required conveying distance is the same. Thus, on the table of distances with print area definitions, the name (column 1 of FIG. 3) is not important, and therefore, in a preferred embodiment, need not be stored in ROM 51.

When it is determined by determiner 50*b* that a paper sheet P is a standard size, the printing region definer 50*c* of CPU 50 defines a region in which printing can be conducted on paper sheet P. This region is defined so that printing is properly performed on each standard size paper sheet. For example, when it is determined by the determiner that the number "n" of driving steps is in the range of "n1 to n1'", the region XP (shown in FIG. 4) in which printing can be conducted is defined as follows:

$$XP=x_1-(y_1\times XL+y_2)$$

Figure 4:
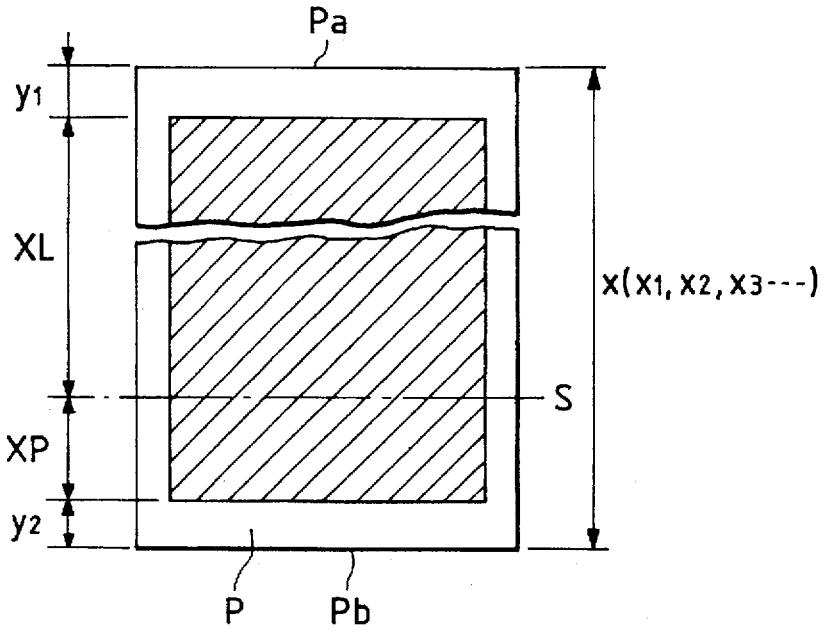
FIG. 4 is a schematic illustration of the region in which printing can be conducted.
Figure 6:
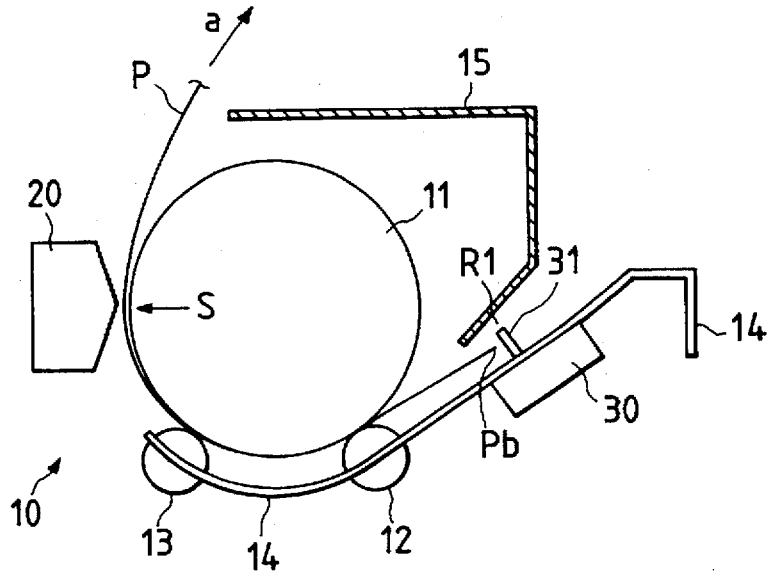
FIG. 6 is a schematic illustration of the detection of the trailing edge of a paper sheet.

As is shown in FIG. 4, "S" represents the position of print head 20 (shown in FIG. 6) when trailing edge Pb of paper sheet P is detected by detector 30. In this case, $y_1$ is a top margin, and $y_2$ is a bottom margin. These margins $y_1$ and $y_2$ are set at a value not less than 0 mm. Together with a printing command signal sent from the host computer, the data is inputted into CPU 50. XL is a length of the sheet that has already been printed on by print head 20 when trailing edge Pb of paper sheet P is detected by detector 30. In the above equation, $x_1$ is a value predetermined based on the standard size of paper sheet P, and the margins $y_1$ and $y_2$ are predetermined values. $XL+y_1$ is a length corresponding to the number "n" of driving steps which have already been performed, so that $XL+y_1$ is determined by the number of driving steps "n". Accordingly, even if detector 30 is inaccurate in detecting trailing end Pb of paper sheet P, the region XP in which printing can be conducted may be precisely determined in accordance with a standard size paper sheet P at all times. It is possible to make $x_1$, $y_1$, XL and $y_2$ correspond to the number of driving steps required to convey paper sheet P, and therefore, it is also possible to define the region XP, in which printing can be conducted, by the number of driving steps required to convey paper sheet P a distance XP.

When size determiner 50*b* determines that a paper sheet P is not of a standard size, that is, when the sheet is continuous or the size is unknown, printing region definer 50*c* of CPU 50 defines a region XP' in which printing can be conducted as follows:

$$XP'=Z-y_2-\gamma$$

$$\gamma=\text{constant}$$

Figure 5:
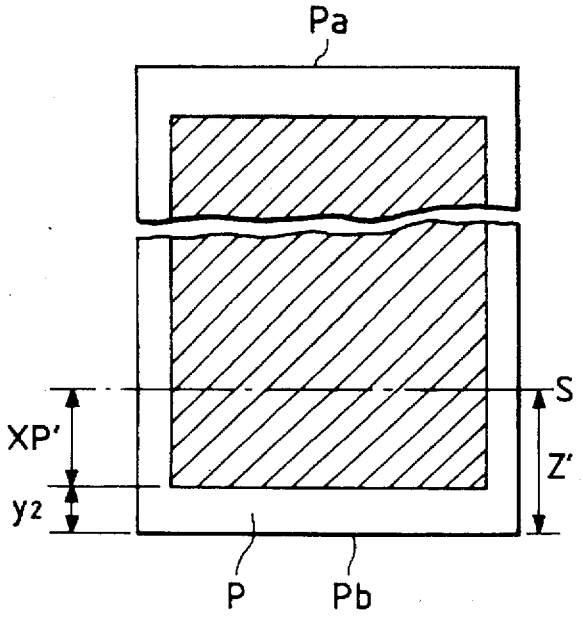
FIG. 5 is a schematic illustration of the region in which printing can be conducted.

In the above equation, Z is a length of the sheet conveyance path from detector 30 to a position S of print head 20. Therefore, Z is a constant. Consequently, if the bottom margin $y_2$ is defined as a constant, XP' will also be a constant. However, as described above, if detector 30 is inaccurate when detecting trailing edge Pb of paper sheet P, the actual length Z' (shown in FIG. 5) from position S of the prim head 20 to trailing edge Pb of paper sheet P will also be inaccurate. Therefore, since the region in which printing can be actually conducted is $Z'-y_2$, assuming $XP'=Z-y_2$, in the case of $Z'>Z$, printing of a certain amount is not actually conducted although there would be room on paper sheet P for printing. In the case of $Z'<Z$, when the bottom margin $y_2$ is set to be very small, that is, for example, when the bottom margin $y_2$ is set to be not more than ½ of the height of a character, a final line would be attempted to be printed although this final line can not be printed in perfect condition, (the lower portions of characters cannot be printed on the sheet and the line should not have been printed). When the paper sheet is not a standard size, since the length of each sheet is different from the length of any other sheet, whether the final line is printed or not causes no serious problems.

Therefore, in this embodiment, $\gamma$ described above is preferably defined so that printing a final line will not be conducted in an incomplete condition in the case of $Z'<Z$ even when the bottom margin $y_2$ is set at an extremely small value.

Printing controller 50*d* of CPU 50 controls all operations of the printer of the invention. After trailing edge Pb of paper sheet P has been detected by detector 30, the printing operation is controlled as follows and is performed in the region XP or XP' in which printing can be conducted, wherein the region XP or xP' is determined as explained above.

Figure 7:
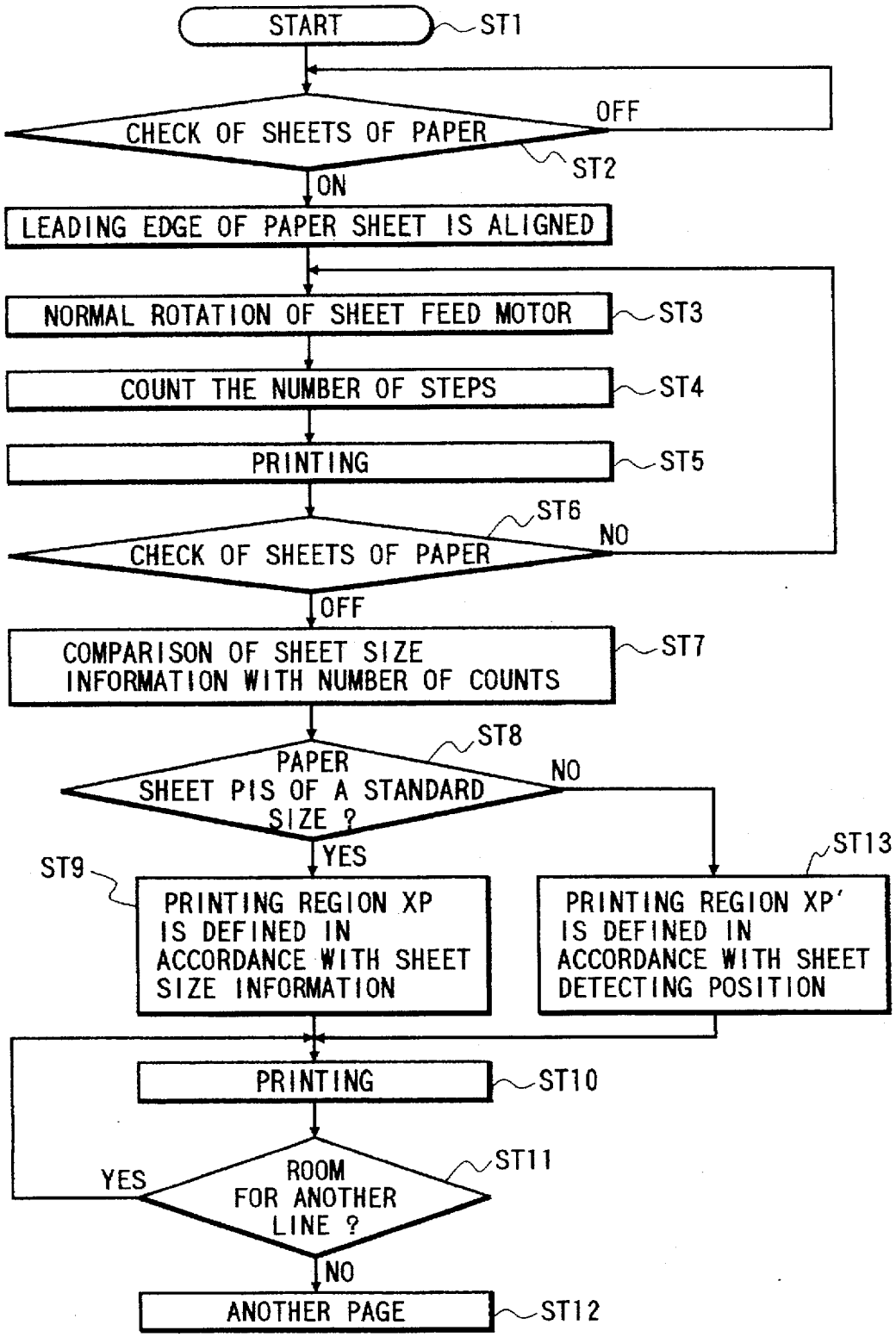
FIG. 7 is a flow chart showing the function of the priming method of the invention.
Figure 9A:
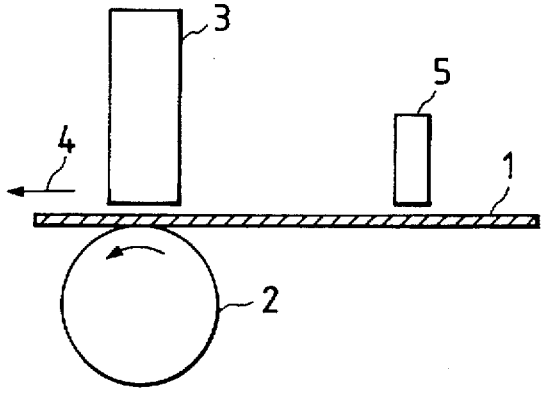
FIG. 9(a) PRIOR ART
FIGS. 9(*a*) and 9(*b*) are schematic illustrations for explaining the prior art.
Figure 9B:
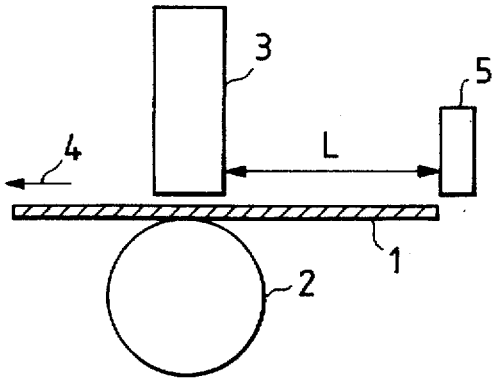
FIG. 9(b) PRIOR ART
Figure 10:
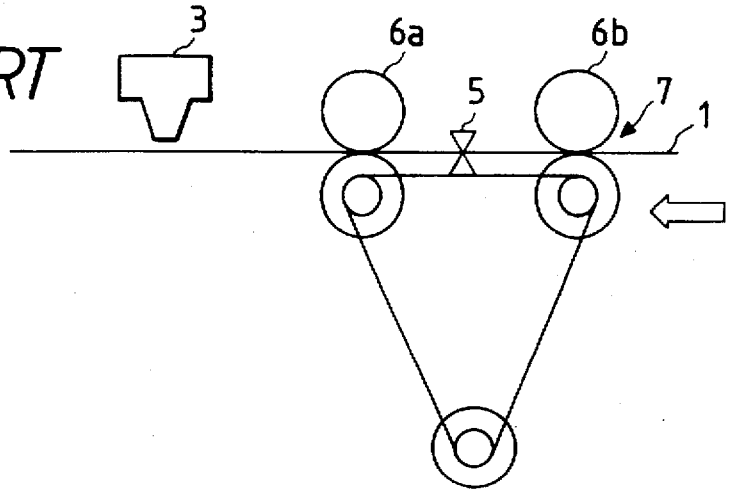
FIG. 10 PRIOR ART
FIG. 10 is a schematic illustration for explaining another case of the prior art.

FIG. 7 is a flow chart depicting schematically the printing method of the invention and also depicting a primary portion of printer operation. With reference to this flow chart and FIGS. 1 and 2, the operation of the above printer will now be explained.

When an electric power source of the printer is turned on, paper sheet P is fed to the conveyance path R1 in step ST1. In step ST2, leading edge Pa of paper sheet P is detected by detector 30. Then leading edge Pa of paper sheet P is aligned when platen 11 is rotated in the reverse direction as described above. Next, step motor 16 is rotated in the forward direction in step ST3, so that the conveyance of the sheet P in the direction of arrow "a" is started. Upon the beginning of this conveyance, in step ST4, computer 50*a* starts counting the number of driving steps of step motor 16.

After paper sheet P has been conveyed to a predetermined position, that is, after paper sheet P has been conveyed to a position where leading edge Pa of paper sheet P passes through head 20 by a distance corresponding to the margin $y_1$, print head 20 is driven in step ST5 to conduct a printing operation. The printing operations described in steps ST3 to ST5 are repeated until trailing edge Pb of paper sheet P is detected by detector 30 in step ST6.

After trailing edge Pb of paper sheet P has been detected by detector 30 in step ST6, the comparison operation is conducted in step ST7 as follows. In step ST7, determiner 50*b* compares the number "n" of driving steps of step motor 16 counted by computer 50*a* when trailing edge Pb of the sheet P is detected by detector 30, with the ranges "n1 to n1'", "n2 to n2'" and the like which are stored in ROM 51.

As a result of the comparison, when the number of steps "n" belongs to one of the ranges of the number of steps stored in ROM 51, such as "n1 to n1'," and "n2 to n2'", it is determined in step ST8 whether paper sheet P is of a standard size. When the number of steps does not belong to any of the ranges of the number of steps such as "n1 to n1'" and "n2 to n2'", it is determined that the paper sheet P is continuous, or is of an unknown size.

If it is determined in step ST8 that paper sheet P is of a standard size, the region XP (shown in FIG. 4) in which printing can be conducted is defined by the printer region definer 50*c* in step ST9 as previously described.

After printing has been further conducted in step ST10, it is determined in step ST11 whether or not sufficient space remains in the printing region for printing the next line. In step ST11, this determination is conducted by print controller 50*d* of CPU 50. When the amount paper sheet P already conveyed, and therefore printed upon, is subtracted from the above region XP in which printing can be conducted, and the result is larger than the region which would be necessary for printing the next line, it is determined that there is enough space left to print another line. If it is determined that there is enough space left in the printing region to print another line, the operations of steps ST10 and ST11 are repeated. If it is determined in step ST11 that there is not enough space left in the printing region to print another line, the program advances to step ST12 and the page is ejected, another page is provided, and then the program returns to step ST1.

If it is determined in step ST8 that paper sheet P is not of a standard size, the region XP' (shown in FIG. 5) in which printing can be conducted is defined by printer region definer 50*c* in step ST13 in the same manner as previously described. Thereafter, printing is further continued in step ST10. Then in step ST11, it is determined whether or not there is enough space to print another line. In step ST11, this determination is conducted by the print controller 50*d* of CPU 50. When the amount of paper sheet P already conveyed, and therefore printed upon, is subtracted from the region XP' in which printing can be conducted, and the result is larger than the region which would be necessary for printing the next line, it is determined that there is enough space left to print another line. If it is determined that there is enough space left in the printing region to print another line, the operations of steps ST10 and ST11 are repeated. If it is determined in step ST11 that there is not enough space left in the printing region to print another line, the program advances to step ST12 and the page is ejected, and another page is provided, and then the program returns to step ST1.

The following operational effects can be provided by the printer of the invention.

(1) When trailing edge Pb of paper sheet P is detected by detector 30, the amount of paper sheet P which has been conveyed from when the conveyance of paper sheet P was started by conveyor 10 until trailing end Pb of the paper sheet P is detected by detector 30 is computed by computer 50*a*. Thereafter, it is determined by determiner 50*b* whether or not paper sheet P is of a standard size. If it is determined by determiner 50*b* that paper sheet P is of a standard size, the region in which printing can be conducted is defined in accordance with the paper size, and printing is thereafter conducted in the printing region.

When paper sheet P is of a standard size, the area of paper sheet P on which printing can be conducted is not found on the basis of when trailing end Pb of the paper sheet P is detected, but rather by the region XP in which printing can be conducted which is defined in accordance with the standard size sheet. Accordingly, even if detector 30 inaccurately detects trailing edge Pb with a small deviation, the region in which printing can be conducted is accurately defined in accordance with the standard size of paper sheet P at all times.

Accordingly, unlike the Printer disclosed in Japanese Unexamined Patent Application No. A-115980 described above, there is no possibility that more printing will be attempted than there is room for, and no space at the bottom will be wasted, i.e. not used if it could be printed on.

Further, unlike the system described in Japanese Unexamined Patent Publication No. 63-74672, even though detector 30 is arranged on the upstream side of the paper conveyance start position, the amount of paper sheet P which has been conveyed is accurately computed, and it is determined whether paper sheet P is of a standard size or not.

On the other hand, if it is determined by the determiner 50*b* that the paper sheet is not of a standard size, a residual amount of paper sheet P on which printing can be conducted is defined on the basis of when trailing end Pb of paper sheet P is detected by detector 30. In this case, the region XP' in which printing can be conducted is defined while allowances are made for a quantity $\gamma$ necessary for absorbing any inaccuracy during the detecting of trailing edge Pb of paper sheet P. Therefore, it is possible to prevent the printing of more text than there is room for.

(2) Conveyer 10 is driven by step motor 16, and computer 50*a* counts the number of driving steps of step motor 16 used to convey paper sheet P, and the counted number of driving steps is used as a measure of sheet conveyance. Therefore, it is possible to compute this amount of the sheet which has been conveyed by the use of a relatively simple structure. The amount of sheet conveyance by the printer described above may be computed by attaching a rotary encoder to a roller (for example, the pinch roller 12) which rotates when brought into contact with a conveyed sheet, so that the quantity of sheet conveyance can be computed. However, if the above structure is adopted, it is necessary to attach this rotary encoder to the roller. Consequently, the structure becomes complicated. On the other hand, according to the printer of the invention, the number of driving steps of step motor 16, which is driving conveyer 10, is counted. Therefore, it is not necessary to provide a separate rotary encoder, and the amount of sheet conveyance can be computed by the use of a relatively simple structure.

(3) In the invention, when leading edge Pa of paper sheet P comes into contact with nip portion 17 between platen 11 and pinch roller 12 composing conveyer 10, leading edge Pa of paper sheet P is aligned. Therefore, simultaneously when platen 11 starts its rotation in the forward direction, the conveyance of the paper sheet P is started. Accordingly, it is possible to compute a quantity of sheet conveyance more accurately.

Figure 8:
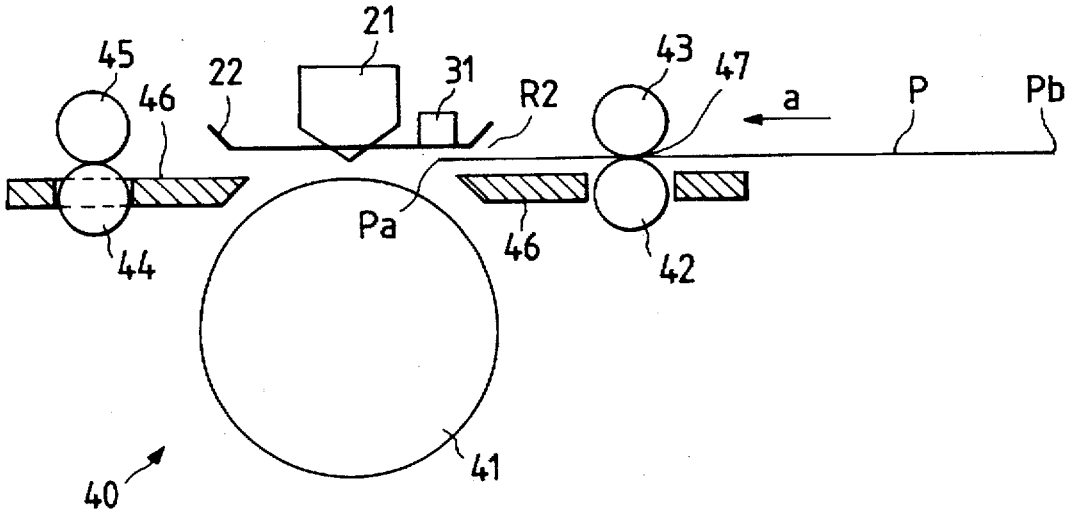
FIG. 8 is a schematic view of the primary portion of the printer constructed in accordance with an alternative embodiment of the invention in which the printing method of the invention is employed.

Reference is now made to FIG. 8 which depicts the primary portion of a printer constructed in accordance with an alternate embodiment of the invention. In FIG. 8, a conveyor 40 for conveying sheets of paper P is shown. The conveyer 40 includes a platen 41, a pair of conveyance rollers 42 and 43 arranged on the upstream side of platen 41, and a pair of conveyance rollers 44 and 45 arranged on the downstream side of platen 41. Rollers 42 and 44 are drive rollers, and rollers 43, 45 are idle rollers which come into pressure contact with drive rollers 42 and 44 respectively so as to be driven thereby. Drive rollers 42 and 44 and platen 41 are driven by step motor 16 (shown in FIG. 2) via a transmission mechanism such as a gear train (not shown). In order to convey paper sheets in a better condition if necessary, it is possible to drive rollers 43 and 45 as well. In addition, a nip portion 47 formed by the pair of conveyance rollers 42 and 43 is a staffing point for sheet conveyance. A sheet guide 46 for guiding a lower surface of the sheet P is also provided. A printing head 21, which conducts printing on paper sheet P conveyed by conveyer 40 in the direction of arrow "a" is also provided.

A detector 31 is arranged on the upstream side of print head 21 and on the downstream side of the sheet conveyance start position. Detector 31 is attached to a sheet guide 22 mounted on print head 21. Detector 31 is composed of a reflecting type optical sensor. When paper sheet P is present under detector 31, detector 31 is activated, and when the paper sheet P is conveyed past detector 31, detector 31 is deactivated. That is, when the sheet P is fed to a conveyance path R2 and leading edge Pa of paper sheet P passes through a position below detector 31, detector 31 is activated. Detector 31 continues to be activated until trailing edge Pb of the paper sheet P passes through the position below the optical sensor. When trailing edge Pb of paper sheet P passes through the position below the optical sensor, detector 31 is deactivated. Accordingly, it is possible to detect the sheet conveyance condition by a change in the ON/OFF signal sent from detector 31.

The block diagram of the primary portion of the printer of this alternative embodiment is substantially the same as that of the first embodiment shown in FIG. 2. Accordingly, the same operation can be carried out.

In the alternative embodiment, the leading edge Pa of paper sheet P is aligned in such a manner that leading edge Pa comes into contact with nip portion 47 of the pair of conveyance rollers 42 and 43 under the condition that the pair of the conveyance rollers 42 and 43 are rotated in the reverse direction or stopped when paper sheet P is being supplied to the conveyance path R2. When the pair of rollers 42 and 43 begin to be rotated in the forward direction, that is, when step motor 16 begins to be rotated in the forward direction, the start point is defined and the drive steps are counted as in the first embodiment and thus the above embodiment can provide the same operational effect as that of the first embodiment described above.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed:

1. A method of printing on a recording medium, comprising the steps of:

providing a printing head for printing on a recording medium;

aligning a recording medium with a nip portion between a platen and a pinch roller;

conveying a recording medium in a first direction by a conveyer from said nip portion;

providing a detector positioned adjacent said printing head in the upstream direction of said direction of conveying of a recording medium;

detecting a trailing edge of a recording medium by a detector;

computing an amount of a recording medium which has already been conveyed upon the detection of said trailing edge;

determining whether a recording medium is of a standard size; and defining a printing region on a recording medium in accordance with the size of a recording medium if a recording medium is a standard size.

2. A printer for printing on a recording medium, comprising:

a print head for printing on a recording medium;

a platen;

a pinch roller;

a nip portion formed between said platen and said pinch roller, a recording medium being aligned with said nip portion;

a conveyer conveying a recording medium in a first direction from said nip portion;

a detector positioned adjacent said print head upstream in said first direction, said detector adapted to detect a trailing edge of a recording medium being conveyed;

a computer computing an amount of a recording medium which has already been conveyed upon the detection of said trailing edge by said detector; and a size determiner determining whether a recording medium is of a standard size and defining a printing region on a recording medium in accordance with the size of a recording medium if a recording medium is a standard size.

3. The printer of claim 2, further comprising a step motor for driving said conveyor, said computer counting the number of driving steps of said step motor from when a recording medium is first conveyed until said detector detects the trailing edge of a recording medium.

4. The printer of claim 2, wherein said platen is positioned opposite said print head, said platen being rotatably driven;

said pinch roller is positioned to selectively come into contact with said platen, said pinch roller being driven to rotate upon coming into pressured contact with said platen; and said conveyer further comprising a step motor for driving said platen of said conveyer, said computer counting the number of driving steps of said step motor from a start of forward rotation of said step motor until the detection of the trailing edge of a recording medium by said detector, said count being retained as a member of the amount of a recording medium which has been conveyed.

5. The printer of claim 2, further comprising an automatic sheet feeder for feeding sheets of recording medium to said conveyer, one by one, a leading edge of each sheet of recording medium being aligned with a conveyance start position of said conveyer.

6. The printer of claim 2, wherein said size determiner uses a count of said computer to determine the size of a sheet of a recording medium, and whether a sheet of a recording medium is of a standard size.

7. The printer of claim 6, wherein printing is performed by said print head in a print area predetermined in accordance with the determined standard size of a sheet of recording medium.

8. The printer of claim 7, wherein a relationship between a recording medium sheet size and print area is stored in a look-up table accessible by said size determiner.

9. A printing method in which printing is conducted by a printing head while a sheet of printing paper is conveyed by a conveyance means and a printing region is set on a sheet of printing paper by detecting a trailing end of a sheet of printing paper with a detecting means arranged on an upstream side of the printing head in the printing paper conveyance direction, the printing method comprising the steps of:

aligning a sheet of paper with a nip portion between a platen and a pinch roller;

computing an amount of printing paper conveyance by said conveyance means from a point of time of a start of conveyance from said nip portion by said conveyance means to a point of time of the detection of the trailing end of the sheet of printing paper;

discriminating by said amount of printing paper conveyance by said conveyance means whether a sheet of printing paper is of regular size or not; and setting a printing region in accordance with the size of a sheet of printing paper when a sheet of printing paper is of regular size.

10. A printer comprising:

a platen;

a pinch roller;

a nip portion formed between said platen and said pinch roller, a sheet of paper being aligned with said nip portion;

conveyance means for conveying a sheet of printing paper from said nip portion;

a printing head for conducting printing on a sheet of printing paper conveyed by said conveyance means;

a detection means for detecting a trailing end of a sheet of printing paper, arranged on an upstream side of the printing head in a printing paper conveyance direction;

computation means for computing an amount of printing paper conveyance by said conveyance means from a point of time of a start of conveyance to a point of time of the detection of the trailing end of a sheet of printing paper by the detection means;

discrimination means for discriminating by an amount of printing paper conveyance by said conveyance means computed by the computation means whether a sheet of printing paper is of regular size or not; and setting means for setting a printing region by a size of sheet of printing paper when a sheet of printing paper is discriminated to be of regular size.

11. The printer according to claim 10, wherein the conveyance means is driven by a step motor, and the computation means counts a number of driving steps of the step motor from the start of conveyance of a sheet of printing paper conducted by the conveyance means so that the number of counted steps is used as amount of printing paper conveyance.

12. The printer according to claim 10, wherein said platen is positioned opposed to the printing head, the platen being rotatably driven; and said pinch roller being rotated while it comes into pressure contact with the platen, wherein the computation means counts the number of driving steps from the start of normal rotation of a step motor to drive the platen so that the number of driving steps is used as amount of printing paper conveyance.

13. The printer according to claim 10, further comprising:

an automatic paper feeder for feeding sheets of printing paper to the conveyance means one by one, wherein a leading end of a sheet of printing paper is aligned when the leading end of a sheet of printing paper fed by the automatic paper feeder comes to a position of the start of sheet conveyance of the conveyance means.

14. The printer according to claim 11, further comprising:

an automatic paper feeder for feeding sheets of printing paper to the conveyance means one by one, wherein a leading end of a sheet of printing paper is aligned when the leading end of a sheet of printing paper fed by the automatic paper feeder comes to a position of the start of sheet conveyance of the conveyance means.

15. The printer according to claim 12, further comprising:

an automatic paper feeder for feeding sheets of printing paper to the conveyance means one by one, wherein a leading end of a sheet of printing paper is aligned when the leading end of a sheet of printing paper fed by the automatic paper feeder comes to a position of the start of sheet conveyance of the conveyance means.

* * * * *